US009545160B2

(12) United States Patent
Mack

(10) Patent No.: US 9,545,160 B2
(45) Date of Patent: Jan. 17, 2017

(54) RESTAURANT SYSTEM AND METHOD FOR OPERATING A RESTAURANT SYSTEM

(71) Applicant: HeineMack GmbH, Nuremberg (DE)

(72) Inventor: Michael Mack, Fuerth (DE)

(73) Assignee: HeineMack GmbH, Nuremberg (DE)

( * ) Notice: Subject to any disclaimer, the term of this patent is extended or adjusted under 35 U.S.C. 154(b) by 0 days.

(21) Appl. No.: 14/777,429

(22) PCT Filed: Mar. 12, 2014

(86) PCT No.: PCT/DE2014/000128
§ 371 (c)(1),
(2) Date: Sep. 15, 2015

(87) PCT Pub. No.: WO2014/139508
PCT Pub. Date: Sep. 18, 2014

(65) Prior Publication Data

US 2016/0029819 A1 Feb. 4, 2016

(30) Foreign Application Priority Data

Mar. 15, 2013 (DE) ..... 10 2013 102 674

(51) Int. Cl.
*A47F 10/06* (2006.01)
*B66B 9/06* (2006.01)
*E04H 3/04* (2006.01)

(52) U.S. Cl.
CPC ..... *A47F 10/06* (2013.01); *B66B 9/06* (2013.01); *E04H 3/04* (2013.01)

(58) Field of Classification Search
CPC ..... A47F 10/06
USPC ..... 186/47, 50
See application file for complete search history.

(56) References Cited

U.S. PATENT DOCUMENTS 448,009 A * 3/1891 Clapp ..... A47F 10/06 186/20
1,606,627 A * 11/1926 Gromer ..... A47F 10/06 186/47
2,216,357 A 10/1940 Smith
2,640,581 A 6/1953 Abitz
3,464,363 A 9/1969 Wishart
(Continued)

FOREIGN PATENT DOCUMENTS

CN CN 202312687 7/2012
DE 25 27 188 A1 9/1976
(Continued)

OTHER PUBLICATIONS

DE 19816768 A1 English machine translation. Retrieved from http://worldwide.espacenet.com/advancedSearch?locale=en_EP.*
(Continued)

*Primary Examiner* — Jonathan Snelting
(74) *Attorney, Agent, or Firm* — The Law Office of James E. Ruland, PLC

(57) ABSTRACT

The invention relates to a restaurant system, and a method relating thereto, including a first transport section, and a second transport section. The second transport section is located upstream of the first transport section in a provided transport direction of the food and/or drinks. The second transport section has an elevator, which is designed to transport the food and/or drinks into a position, which is located at a higher point as compared to the guest area.

20 Claims, 6 Drawing Sheets

(56) References Cited

U.S. PATENT DOCUMENTS

| | | | | |
|---|---|---|---|---|
| 3,577,930 | A | 5/1971 | Rooklyn | |
| 3,734,028 | A | 5/1973 | Robertson | |
| 3,857,463 | A | 12/1974 | Wagenfuehrer et al. | |
| 3,985,206 | A | 10/1976 | Rodriguez-Cantos | |
| 3,998,497 | A | 12/1976 | Koizumi | |
| 4,005,745 | A | 2/1977 | Colato et al. | |
| 4,015,537 | A | 4/1977 | Graef et al. | |
| 4,019,605 | A * | 4/1977 | Kropf | B66B 9/00 104/127 |
| 4,346,945 | A | 8/1982 | Tsuboi | |
| 4,347,923 | A | 9/1982 | Wong | |
| 4,375,195 | A | 3/1983 | Tsuboi | |
| 4,387,481 | A | 6/1983 | Zalewski | |
| 4,627,529 | A | 12/1986 | Tarlton et al. | |
| 4,831,937 | A | 5/1989 | Yamada | |
| 5,119,734 | A | 6/1992 | Schwarzkopf | |
| 5,146,854 | A | 9/1992 | Poulos | |
| 5,168,801 | A | 12/1992 | Switek, Jr. | |
| 5,186,433 | A | 2/1993 | Pausch | |
| 5,272,984 | A | 12/1993 | Bolliger et al. | |
| 5,299,507 | A | 4/1994 | Maynard, Sr. | |
| 5,303,810 | A | 4/1994 | Tani | |
| 5,320,210 | A | 6/1994 | Van Den Bergh et al. | |
| 5,397,211 | A | 3/1995 | Lloyd et al. | |
| 5,403,238 | A * | 4/1995 | Baxter | A63G 31/16 104/78 |
| 5,413,414 | A | 5/1995 | Bauer | |
| 5,496,115 | A | 3/1996 | Bauer | |
| 5,537,929 | A | 7/1996 | Miura et al. | |
| 5,572,930 | A | 11/1996 | Hein | |
| 5,711,227 | A | 1/1998 | Johnson | |
| 5,738,016 | A | 4/1998 | Scott | |
| 5,816,443 | A | 10/1998 | Bustos | |
| 5,857,560 | A | 1/1999 | Björkholm | |
| 5,910,192 | A | 6/1999 | Pulford, Jr. et al. | |
| 6,047,645 | A | 4/2000 | Cornwell et al. | |
| 6,102,194 | A | 8/2000 | Charny | |
| 6,158,568 | A | 12/2000 | Erceg et al. | |
| 6,386,356 | B1 | 5/2002 | Eberle | |
| 6,427,806 | B1 | 8/2002 | Tanaka | |
| 6,520,641 | B1 | 2/2003 | Walton et al. | |
| 6,561,103 | B2 | 5/2003 | Peck | |
| 6,581,727 | B1 | 6/2003 | Tokuno | |
| 6,626,117 | B1 | 9/2003 | Chapman | |
| 6,675,950 | B1 | 1/2004 | Collon | |
| 6,758,650 | B2 | 7/2004 | Drei et al. | |
| 6,907,985 | B1 | 6/2005 | Axmann | |
| 7,243,758 | B2 | 7/2007 | Ishino et al. | |
| 7,381,022 | B1 * | 6/2008 | King | B65G 1/0492 187/270 |
| 7,650,843 | B2 | 1/2010 | Minges | |
| 2003/0075070 | A1 | 4/2003 | Spielberg et al. | |
| 2004/0120615 | A1 | 6/2004 | Chase | |
| 2004/0249497 | A1 | 12/2004 | Saigh et al. | |
| 2005/0121293 | A1 | 6/2005 | Rice et al. | |
| 2006/0145442 | A1 | 7/2006 | Van Loon et al. | |
| 2007/0000207 | A1 | 1/2007 | Bernhard | |
| 2007/0187183 | A1 | 8/2007 | Saigh et al. | |
| 2009/0101445 | A1 * | 4/2009 | Mack | A47F 10/06 186/38 |
| 2009/0107803 | A1 | 4/2009 | Ellerth et al. | |
| 2010/0143079 | A1 | 6/2010 | Iijima | |

FOREIGN PATENT DOCUMENTS

| | | | | |
|---|---|---|---|---|
| DE | 36 02 342 | C1 | 6/1987 | |
| DE | 19816768 | A1 * | 11/1999 | A63G 7/00 |
| DE | 102005059188 | A1 | 6/2007 | |
| GB | 695999 | | 8/1953 | |
| GB | 895714 | | 5/1962 | |
| GB | 2 207 406 | A | 2/1989 | |
| JP | 11244119 | A | 9/1999 | |
| WO | WO 03047711 | A1 * | 6/2003 | A63G 7/00 |
| WO | WO 2011065141 | A1 | 6/2011 | |

OTHER PUBLICATIONS

WO 03/047711 A1 English machine translation. Retrieved from http://worldwide.espacenet.com/advancedSearch?locale=en_EP.*
International Search Report of WO 2007/068426 A, Jun. 21, 2007.
Yoshio, "Device for Carrying Table Ware Containing Box in Rotary Sushi Restaurant", Sep. 14, 1999, Publisher: Patent Abstracts of Japan.
Search Report from International Application No. PCT/DE2014/000130 filed Mar. 12, 2014, now U.S. National Stage U.S. Appl. No. 14/777,478, filed Sep. 15, 2015.
U.S. Appl. No. 14/777,478, filed Sep. 15, 2015, Mack.
Second Office Action of DE10 2013 102 6745 mailed Apr. 30, 2014.
DE 10 2005 059 188 B4 is in the same family of patents as US 2009/101445 A1, which is cited on PTO/SB/08a filed Nov. 17, 2015.
DE 10 2005 059 188 A1 is in the same patent family as US 2009/101445 A1, which was cited in the PTO/SB/08a filed Nov. 17, 2015. 2015. US 2009/101445 A1 can serve as a translation.
U.S. Pat. No. 4,019,605 is cited in a PTO/SB/08a form submitted herewith.
EP 1 833 331 B1 is in the same family of patents as US 2009/101445 A1, which is cited in PTO/SB/08a filed Nov. 17, 2015.
First Office Action of DE 10 2013 102 674.5 mailed Dec. 4, 2013.
First Reply of DE 10 2013 102 674.5 filed Apr. 17, 2014.
Second Office Action of DE10 2013 102 674.5 mailed Apr. 30, 2014.
Decision to Grant for DE 10 2013 102 674.5 mailed Oct. 14, 2014.
Translation of Written Opinion in PCT/DE2014/000128 mailed Sep. 15, 2015.
Translation of Search Report for PCT/DE2014/000128 mailed Sep. 18, 2014.
Abstract of WO 2011/065141 A1 published Jun. 3, 2011.
CN 101282669 is in the same family of patents as US 2009/101445 A1, which is cited on SB/08a filed Nov. 17, 2015.
CN 1756696 is in the same family of patents as US 2006/145442 A1, cited herein.
Office Action for U.S. Appl. No. 14/777,478 mailed May 11, 2016.
Search Report for CN 105338862 dated Jul. 8, 2016 is in same patent family as present U.S. Appl. No. 14/777,429.

* cited by examiner

RESTAURANT SYSTEM AND METHOD FOR OPERATING A RESTAURANT SYSTEM

CROSS-REFERENCE TO RELATED APPLICATIONS

This application is a national phase application of International Application No. PCT/DE 2014/000128 filed 12 Mar. 2014, and claims the priority of German Application No. 10 2013 102 674.5 filed 15 Mar. 2013, the content of both of which is incorporated herein by reference.

The invention relates to a restaurant system (also: catering system) according to the preamble of claim 1.

Such a restaurant system comprises at least one working area for cooking and/or preparing food and/or drinks and at least one guest area. Working area and guest area are connected via a transport system for food and/or drinks. The transport system is designed to transport food and/or drinks from the working area to the guest area. The transport system has at least a first transport section, in which the transport of food and/or drinks from the working area to the guest area takes place at least in sections by means of the force of gravity. Such a restaurant system is known from DE 10 2005 059 188 B4 and EP 1 833 331 B1.

A restaurant system hereby does not only refer to systems for restaurants in the narrower sense, but, in general, to systems for all types of catering, thus also mobile or fixedly installed food stands, beer gardens, fast-food restaurants and drive-in restaurants, for example, in addition to restaurants and taverns. A restaurant system furthermore also refers to a drivable serving trolley, which can be pushed from table to table, for example in restaurants or children's hotels, so as to serve the food and/or drinks on or to the respective table in a spectacular manner, e.g. driving through a looping. In general, drivable serving or snack systems, for example systems, which are designed as trailers or as self-propelled mechanisms, comprising a corresponding setup as restaurant systems in terms of the invention.

For example, the working area is an area, which comprises kitchen and/or bar. It can be a food stand or simply also a simple space for making or preparing the food and/or drinks, for example. The working area can furthermore simply also be the area, in which food and/or drinks are placed into or onto the transport system, respectively, as can be the case in the case of the above-mentioned serving trolley, for example. The guest area is the area, in which the guests of the restaurant, food stand, beer garden, etc. stay. Typically, tables and chairs are available here. However, it can also be a counter or a drive-in area, at which guests have food and/or drinks delivered to their car.

However, in the case of a food stand, for example, guest area also refers to a simple dispensing area for food and/or drinks, at which the guests receive their food and/or drinks. The transport of food and/or drinks takes place in a first transport section from the working area to the guest area via the transport system at least in sections by means of the force of gravity. This means that neither a waiter brings food and drinks to the guests, nor that the guests need to get the food and drinks themselves. Transport systems, which are driven completely electrically or which are driven in any other manner, are also not provided in the first transport section for the food and drinks, for example conveyor belts, as it is known from some restaurants, in particular from Japanese restaurants. At the onset of the transport in the first transport section, the transport of the food and drinks by means of the force of gravity as known from DE 10 2005 059 188 B4 and EP 1 833 331 B1, requires a minimum level of potential energy of the food and/or drinks. If the working area is not located at a higher point than the guest area or if it is not located high enough with regard to the guest area so as to make it possible to transport the food and/or drinks at least in sections by means of the force of gravity, this leads to the requirement for the restaurant system to have the capability to transport the food and/or drinks into a position, which is located at a higher point as compared to the guest area, so as to provide for a transport in the first transport section by means of the force of gravity.

The instant invention is thus based on the object of specifying a new restaurant system or a new method, respectively, for operating a restaurant system, in particular a restaurant system or a method for operating a restaurant system, respectively, in the case of which food and/or drinks can be transported into a position, which is located at a higher point as compared to the guest area.

With regard to the restaurant system, this object is solved by means of the features of claim 1 and with regard to the method for operating a restaurant system, this object is solved by means of the features of claim 20. Advantageous designs and further developments are specified in the respective dependent claims.

The restaurant system according to the invention is characterized in that the transport system has a second transport section, which, in a provided transport direction of the food and/or drinks, is located upstream of the first transport section, wherein the second transport section has an elevator, which is designed to transport the food and/or drinks into a position, which is located at a higher point as compared to the guest area. The elevator according to the invention can be designed to transport the food and/or drinks obliquely upwards. However, a design of the elevator, in the case of which the food and/or drinks are transported upwards substantially inversely parallel to the force of gravity, that is, the transport with the elevator substantially takes place vertically upwards, oriented opposite to the force of gravity, is preferred. The transport of the food and/or drinks takes place in that potential energy, which is converted into kinetic energy in the first transport section by accelerating the food and/or drinks by means of the force of gravity, is supplied to the food and/or drinks in the second transport section. The food and/or drinks also continue to move without an additional drive in the first transport section at least in sections in this manner. By converting the potential energy, which is supplied in the second transport section, into kinetic energy, the food and/or drinks can also overcome frictional forces and/or partial sections comprising an incline when being further transported. The potential energy, which is supplied in the second transport section, thus makes it possible for the transport of the food and/or drinks to take place completely or at least in sections by means of the force of gravity in the first transport section.

A manual activity (activity by humans) is not considered to be part of the transport system. According to an alternative, operating personnel only places the food and drinks into the transport system in or at the working area, respectively—in suitable containers, if applicable—in the proposed restaurant system, namely in a particularly advantageous alternative into special transport aids, for example transport carriages, and the guest removes the food and/or drinks from the transport system in the guest area.

The advantages of the invention lie in particular in supplying potential energy, which can subsequently be converted into kinetic energy at least partially in response to the transport of the food and/or drinks to the guest area, to the food and/or drinks by transporting them into a position, which is located at a higher point than the guest area, in that the food and/or drinks are accelerated by means of the force of gravity in the first transport section. This provides for an impact-free supplying of the food and/or drinks from the working area into the guest area. A further advantage of the restaurant system according to the invention is that working area and guest area can be arranged relative to one another arbitrarily. In particular, the working area does not need to be located at a higher point than the guest area. For example, working area and guest area can be located at one level. The transport of the food and/or drinks by means of the transport system takes place in that the required potential energy, which is subsequently converted into kinetic energy at least partially and which is sufficient to pass through the remainder of the transport path completely or at least in sections without a further drive and without further energy supply, is supplied to the food and/or drinks by means of the elevator. The kinetic energy is reduced thereby, for example by carrying out frictional and lifting work, wherein the potential energy gained by means of lifting work can be transferred at least partially into kinetic energy again by means of the force of gravity and can thus be used for transporting the food and/or drinks again.

The transport system can consist of a first and a second transport section. However, it is also possible for the transport system to additionally comprise a third transport section, which is located upstream of the second transport section in a provided transport direction of the food and/or drinks and in which the transport of food and/or drinks from the working area to the guest area takes place at least in sections by means of the force of gravity. The transport thus takes place at least in sections by means of the force of gravity in the first and third transport section; in the second transport section, which is provided between these transport sections, the transport takes place by means of an elevator.

Provision can also be made for the transport system to have two or a plurality of first transport sections in series, in which the transport of the food and/or drinks from the working area to the guest area takes place at least in sections by means of the force of gravity, wherein the transport system has two or a plurality of second transport sections, which are located upstream of one of the first transport section in a provided transport direction of the food and/or drinks, wherein the second transport sections in each case have an elevator, which is designed to transport the food and/or drinks into a position, which is located at a higher point as compared to the guest area.

Except for the above-listed basic design, the different first transport sections and the different second transport sections do not need to correspond to one another, can thus indeed be designed differently. Such a design of the transport system is advantageous in particular if the potential energy, which is supplied to the food and/or drinks in a sole second transport section, is not sufficient for completely transporting the food and/or drinks from the working area to the guest area by means of the force of gravity.

This is in particular the case, when the height of the position, which is located at a higher point as compared to the guest area, in a sole second transport section in relation to the path from the working area to the guest area is not large enough to provide sufficient potential energy.

According to a further development of the invention, the elevator is designed to transport the food and/or drinks upwards, substantially inversely parallel to the force of gravity. A further development of the invention provides for the elevator to have at least one movable elevator unit, which carries the food and/or drinks by means of the elevator during the transport of the food and/or drinks. A particularly advantageous further development of the invention provides for the elevator unit to be movable between a receiving position, in which the food and/or drinks, which are to be transported, can be supplied to the elevator unit, and a transfer position arranged above the receiving position, in which the food and/or drinks can be transferred to the first transport section by the elevator unit.

According to a design alternative, the elevator has one or two or a plurality of sensors, which detect the reaching of the receiving position and/or of the transfer position.

For example, these sensors transfer the reaching of the receiving position and/or of the transfer position to a control device of the elevator, which stops the movement of the elevator unit. The supplying of the food and/or drinks in the receiving position of the elevator unit and the transfer of the food and/or drinks in the transfer position of the elevator unit are made possible through this. Provision can also be made for the sensors to monitor the loading state of the elevator unit and transmit to the control device, whether food and/or drinks are located on or at the elevator unit. The control device can thus release a movement of the elevator unit, if the food and/or drinks were transferred to the first transport section in the transfer position or can release a movement of the elevator unit, respectively, if a loading of the elevator unit had been carried out in the receiving position. An advantageous further development provides for the elevator unit to have at least one barrier, which, in a closed state, blocks a movement of the food and/or drinks carried by the elevator unit, and which, in an open state, releases a movement of the food and/or drinks carried by the elevator unit, in particular a transfer to the first transport section.

Such a barrier is in particular advantageous when the food and/or drinks on the elevator unit stand substantially at an incline as compared to a horizontal. The force of gravity then acts on the food and/or drinks and would transport them in the direction of the inclination without being impeded. This movement by means of the force of gravity is prevented in the closed state by means of the carrier and is released in the open state by means of the barrier, in particular specifically for the transfer to the first transport section. The at least one barrier can be connected to the control device, which has already been mentioned above. If, for example, one of the sensors signals the reaching of the transfer position to the control device, the latter can transfer the barrier from the closed into the open state, and can thus release the transfer of the food and/or drinks to the first transport section.

Provision can furthermore be made in the first and/or in the second transport section for at least one or at least two or a plurality of barriers, which are coupled to sensors and/or to the control unit. For example, provision can be made in transport direction of the food and/or drinks for an upstream second, an upstream first, a downstream second and a downstream first transport sections, wherein the elevators in each case have one barrier in the second transport sections, and wherein, in the downstream second transport section, the elevator comprises sensors, which detect the load status (loaded or empty) of the elevator. The information relating to the load status are transferred to the control device, which opens or closes the barrier on the elevator of the upstream second transport section as a function of the respective load state. If the elevator is empty in the downstream second transport section, the barrier on the elevator is also released or remains open in the upstream second transport section. If the elevator is loaded in the downstream second transport section, the barrier on the elevator is not released or remains closed in the upstream second transport section. Provision can furthermore be made for a barrier on the elevator to remain closed in the upstream second transport section, as long as the elevator unit of the elevator moves upwards in the downstream second transport section and is opened again, as soon as the elevator unit has arrived at the receiving point again.

For example, the barrier is a mechanical coupling mechanism comprising an L-shaped angular piece, wherein, in the closed state, the short side of the angular piece forms the stop point for the transport aids or for the food and/or drinks, respectively. A further development of the invention provides for the elevator to comprise one or two or a plurality of guide rods, which are preferably arranged substantially vertically, for guiding the elevator unit in response to the movement between receiving position and transfer position.

For guiding purposes, provision can furthermore be made on the guide rod or the guide rods for the elevator unit to have two or three or a plurality of wheels for each guide rod, which are arranged in such a manner that at least two of the wheels are moved along opposite sides of the guide rods in response to the movement of the elevator unit.

For example, the wheels can be designed in a double cone-shaped manner, wherein the guide rods are guided in an area between the two cones on a cylindrical center piece. Preferably, provision is made for three wheels for each guide rod, wherein the axes of rotation of the wheels are located vertically to the guide rods and the wheels are located in a plane, which is vertical to the axes of rotation. The wheels are thereby arranged in the plane in the shape of a triangle, preferably in the shape of an equal-sided triangle, wherein the guide rods are in each case arranged between base and tip of the equal-sided triangle. Provision can additionally be made for the wheels to be equipped with a brake to prevent an unintentional quick downward slipping of the elevator unit, for example in response to a tearing of a traction element. Provision can furthermore be made for the elevator unit to have a frame structure, preferably comprising two mounting plates, to which the wheels are rotatably attached in a rotatable manner.

Preferably, a stationary connector is arranged on or close to an upper end of the guide rods in such a manner that the food and/or drinks can be transferred via the connector to the first transport section, starting at the elevator unit in the transfer position thereof.

According to a design alternative, the position of the connector on or close to the upper end of the guide rods can be adjusted, in particular one or a plurality of fastening means of the connector on one or a plurality of the guide rods can be fastened again to the guide rod or the guide rods in a detachable and offset manner.

In the alternative or in addition, the position of the connector on or close to the lower end of the guide rods can be adjustable. A particularly advantageous further development of the invention provides for the elevator to have a drive system comprising a motor and at least one or at least two traction elements, which are moved by the motor, in particular traction ropes or tie bars, wherein the elevator unit is connected to the traction element or to the traction elements in such a manner that the elevator unit is moved by means of the traction element or the traction elements. Each traction element, for example each traction rope or tie bar, can be stretched circumferentially between a drive roller on the motor and a deflection roller.

For example, the motor comprising the drive roller can be arranged on or close to the lower end of the guide rods and the deflection roller can be arranged on or close to the upper end of the guide rods. To connect the elevator unit to the traction element or traction elements, provision can be made, for example, for a mechanical connection, which clamps the traction elements and which ensures a stable and slip-resistant fastening. Compared to the provision of only one traction element, the provision of two or a plurality of traction elements has the advantage of an improved safety against an unintentional slipping of the elevator unit when the traction elements fail, for example tear. In the event that this should actually happen, the additional traction element nonetheless keeps the elevator unit in its position.

The elevator can furthermore comprise a base plate on or close to the lower end of the guide rods. The guide rods and/or the motor can be fastened to this base plate. A control device of the elevator, to which the control devices that have already been discussed above can belong as well, can furthermore be arranged on or also below the base plate. According to a further development of the invention, the elevator comprises an emergency shut-off system, wherein the emergency shut-off system comprises a number of contact elements, which corresponds to the number of the traction elements, wherein one contact element is in each case in contact with a traction element during normal operation and wherein the contact is interrupted in the case of malfunction.

Normal operation refers to the state of the elevator, in which errors, such as the tearing of one traction element or of a plurality of traction elements, occur or have occurred. In normal operation, the traction elements are furthermore stretched between drive roller and deflection roller.

If a malfunction occurs, that is that one or a plurality of traction elements tear, the contact between the respective traction elements and the contact elements is interrupted and the emergency shut-off system is triggered, wherein the elevator is stopped by stopping the motor. After the repair of the damaged traction element of or the damaged traction elements, the elevator can be started up again by means of a specific key position on the control device. Provision can furthermore be made for the elevator to comprise a brake mechanism comprising brake elements, wherein the brake effect of the brake elements is impeded by means of the traction elements during normal operation, whereas contact is established between the brake elements and further parts of the elevator during malfunction due to the tearing of the traction elements, so that the elevator is slowed down. Preferably, the device comprising the brake elements can be held at the traction elements.

It is ensured in this manner that a brake effect already occurs in response to the tearing of a traction element. For example, the brake mechanism can subsequently be released again manually and/or mechanically. According to a further development of the invention, the elevator has a protective box, which surrounds the elevator unit in the receiving position thereof at least laterally and/or the elevator unit has a protective box, which is movable with the elevator unit and which surrounds the elevator unit at least laterally.

In the event that the elevator has a protective box, which surrounds the elevator unit in the receiving position thereof at least laterally, the protective box preferably is a stationary protective box, which is not moved with the elevator unit.

The protective box can be a protective box comprising four side walls, which stand on a bottom or on the above-mentioned base plate, for example. The upper side of the protective box can be open, so as not to impede the movement of the elevator unit. Preferably, the walls of the protective box are designed so as to be completely or partially transparent or translucent.

For example, the walls can be made substantially of Plexiglas. In the event that the elevator unit has a protective box, which can be moved with the elevator unit and which surrounds the elevator unit at least laterally, provision can furthermore be made for the elevator to have one or two or a plurality of sensors, which detects or detect an intervention in the route of the elevator unit along the guide rods by an operator. For example, an optical or an acoustic warning signal can be output or the elevator can be turned off, respectively, if an operator intervenes in the route of the elevator unit. Injuries to the operating personnel can be prevented in this manner.

According to a further development, the protective box has a loading opening, via which the food and/or drinks can be supplied to the elevator unit in the receiving position thereof. The loading opening can be provided with a door, in particular with a sliding door. The provision of a sensor, which detects an approach and which opens the door of the loading opening automatically and closes it again after the food and/or drinks have been supplied, is advantageous.

However, provision can also be made for manual operating devices for opening and closing the door. A particularly advantageous further development of the invention provides for the first transport section of the transport system to comprise at least two sliding rails and/or roller guides, which run substantially parallel, in particular at least two sliding rails and/or roller guides, which have a substantially circular or oval or rectangular cross section, on which the food and/or drinks are transported at least in sections by means of the force of gravity by means of transport aids, in particular sliding supports and/or sliding devices and/or rolling devices and that the elevator unit has a number of transfer rails, which run substantially parallel and the number of which corresponds to the number of the sliding rails or roller guides, respectively, in the first transport section and which, during the transport of the food and/or drinks with the elevator, carry the food and/or drinks, which are placed into the transport aids, wherein, in the transfer position of the elevator unit, the transfer rails form a continuation of the sliding rails and/or roller guides in the first transport section in a direction opposite to the provided transport direction of the food and/or drinks.

The transport aids can have two or a plurality of guide components, for example, which at least partially encompass the sliding rails and/or roller guides, which in particular encompass at least half of the sliding rail or roller guide circumference, respectively, which preferably encompass at least two thirds of the sliding rail or roller guide circumference, respectively.

The guide components can be connected to one another, for example via a ring component, which is placed or hooked into a container comprising the food and/or drinks, which are to be transported, wherein the ring component is preferably connected to the guide components in a movable manner. Provision can be made for the elevator to be designed in such a manner that the elevator can transport one or two or a plurality of transport aids at the same time. The transfer rails can, but do not need to adjoin the sliding rail and/or roller guides directly.

As will be explained below, provision can also be made for example between the transfer rails and the sliding rails and/or roller guides for intermediate rails of a connector, as has already been described. Preferably, the connector has a number of intermediate rails, which run substantially parallel and the number of which corresponds to the number of sliding rails or roller guides, respectively, in the first transport section, which form a continuation of the sliding rails and/or roller guides and which are arranged between the sliding rails and/or roller guides and the transfer rails in the transfer position of the elevator unit.

An advantageous further developments provides for the transfer rails and/or the intermediate rails to be inclined downwards in the direction of the provided transport direction of the food and/or drinks, that is, in the direction of the force of gravity. This has the advantage that the force of gravity accelerates the transport aids comprising the food and/or drinks in the provided transport direction. Provision can be made for the transfer rails and/or the intermediate rails to be formed of a plurality of wheels or rollers, which are arranged consecutively and which are supported rotatably, and the axis of rotation of which is in each case oriented substantially vertically to the transport direction provided at the position thereof. In the alternative, provision can be made for the transfer rails and/or the intermediate rails to be designed as sliding rails.

Provision can be made for the transport aids to be guided along the transfer and/or intermediate rails by means of the wheels or rollers, in particular via guide components of the transport aids, which bear on the wheels or rollers—in the case of a corresponding design of the transport aids. This has the advantage that the frictional forces are significantly lower than in response to the use of a sliding rail for the transfer and intermediate rails and that the acceleration of the transport aids comprising the food and/or drinks from the prior art is possible in response to a significantly smaller inclination of the rails than in the case of sliding rails without wheels or rollers. The transport aids are accordingly accelerated more strongly in the area of the transfer rails and/or intermediate rails than in response to the use of sliding rails. They are thus transferred to the sliding rails of the first transport section or to a further partial area of the first transport section at a comparatively high speed and can be transported further along the sliding rails at that location by means of the force of gravity.

Provision can furthermore be made for the transport system in the first transport section to comprise sliding rails and for the transfer and intermediate rails in the second transport section to also be designed as sliding rails. The transport system would thus exclusively have sliding rails in the entire area. Provision can also be made for the transport aids to comprise rollers, which are rotatably arranged on the transport means in such a manner that the transport means move on rails by means of the rollers. The rollers can thereby be designed so as to be self-braking. The method according to the invention for operating the above-described restaurant system according to the invention comprises the steps:

- positioning the elevator unit in its receiving position; subsequently supplying food and/or drinks to the elevator unit, in particular by means of placing into or placing onto the elevator unit;
- subsequently moving the elevator unit comprising the supplied food and/or drinks from the receiving position into the transfer position;
- subsequently transferring the food and/or drinks to the first transport section;
- subsequently transporting the food and/or drinks via the first transport section to the guest area, namely at least in sections by means of the force of gravity. Provision can be made, subsequent to the positioning of the elevator unit in its receiving position, for a sensor to transfer the reaching of the receiving position to a control device of the elevator, which stops the movement of the elevator unit.

In the alternative or in addition, provision can be made, subsequent to the movement of the elevator unit comprising the supplied food and/or drinks from the receiving position into the transfer position, for a sensor to transfer the reaching of the transfer position to a control device of the elevator, which stops the movement of the elevator unit.

An advantageous further development of the method according to the invention provides for at least one barrier, which, in a closed state, blocks a movement of the food and/or drinks, which are carried by the elevator unit, to be shifted into an open state, in which it releases a movement of the food and/or drinks, which are carried by the elevator unit, in particular a transfer to the first transport section, prior to transferring the food and/or drinks to the first transport section. With regard to the further design of the restaurant system, for example with regard to rails and rail systems, transport aids and containers for the food and/or drinks, reference is made to the restaurant systems described in DE 10 2005 059 188 B4 and to EP 1 833 331 B1.

The features of restaurant systems described in these publications can also be realized in the case of the restaurant system according to the invention. The invention will be explained in more detail below, also with regard to further features and advantages, by means of the description of exemplary embodiments and with reference to the enclosed schematic drawings.

Parts and components in FIG. 1 to FIG. 6, which correspond to one another, also beyond the different exemplary embodiments, are detected with the same reference numerals.

Figure 1:
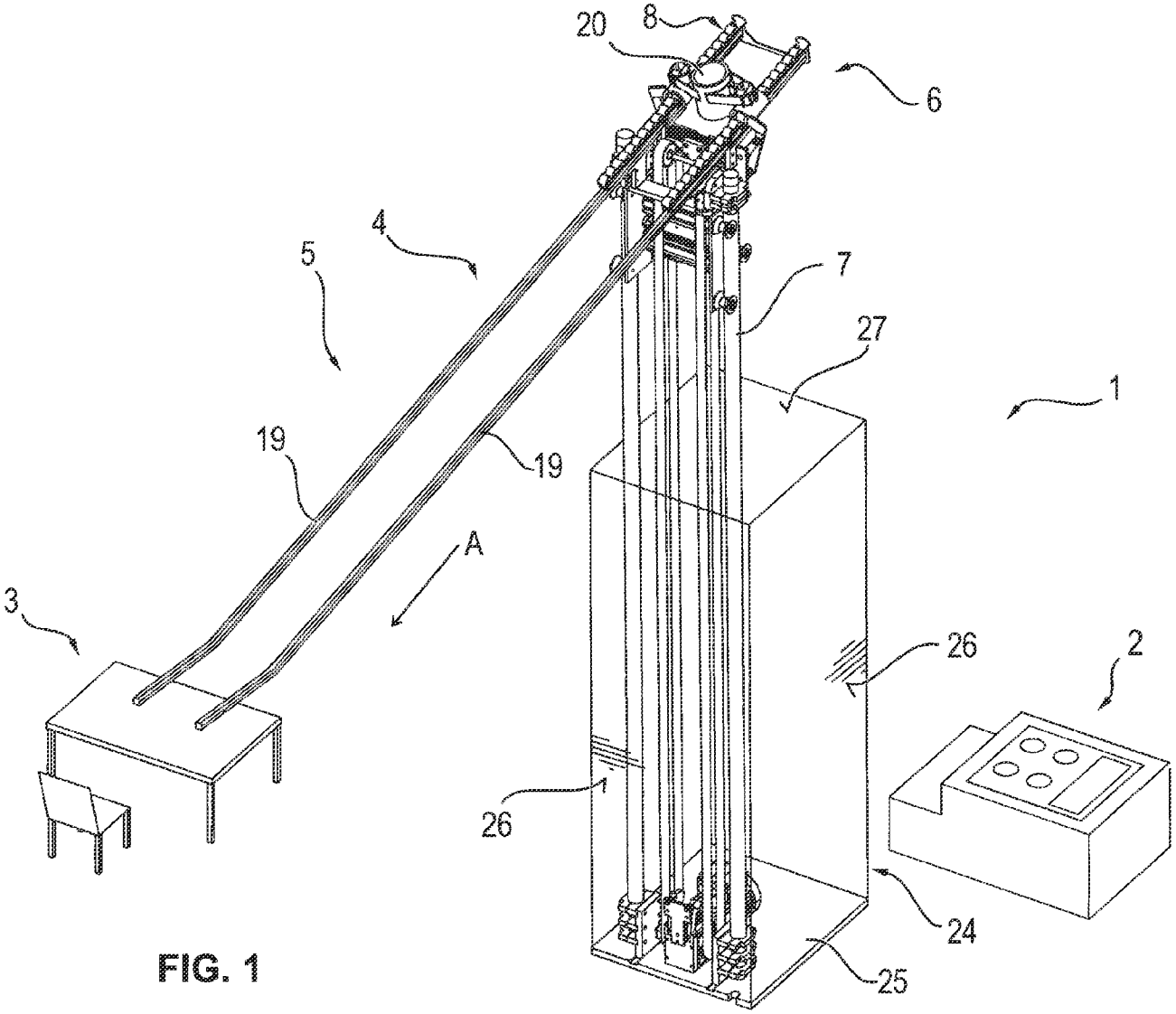
FIG. 1 shows an exemplary embodiment of a restaurant system according to the invention in a schematic view.

FIG. 1 shows a restaurant system 1 according to the invention. The restaurant system comprising a working area for cooking and/or preparing food and/or drinks and a guest area 3, wherein working area 2 and guest area 3 are connected via a transport system 4 for food and/or drinks.

The transport system is designed to transport food and/or drinks from the working area 2 to the guest area 3, wherein the transport system 4 has a transport section 5, in which the transport of food and/or drinks from the working area 2 to the guest area 3 takes place at least in sections by means of the force of gravity. The transport system 4 furthermore has a second transport section 6, which is located upstream of the first transport section 5 in a provided transport direction A of the food and/or drinks. The second transport section 6 has an elevator 7, which is designed to transport the food and/or drinks into a position, which is located at a higher point as compared to the guest area 3. The elevator 7 thus serves the purpose of transporting the food and/or drinks upwards substantially inversely parallel to the force of gravity, that is, the transport by means of the elevator 7 takes place substantially vertically upwards, opposite to the force of gravity.

The elevator has a stationary protective box 24, which laterally surrounds the elevator unit 8 in its receiving position 12, but which is not moved with the elevator unit 8. The protective box 24 comprises four side walls 26, which stand on the base plate 25. The upper side 27 of the protective box 24 is open, so as not to impede the movement of the elevator unit 8.

Figure 2:
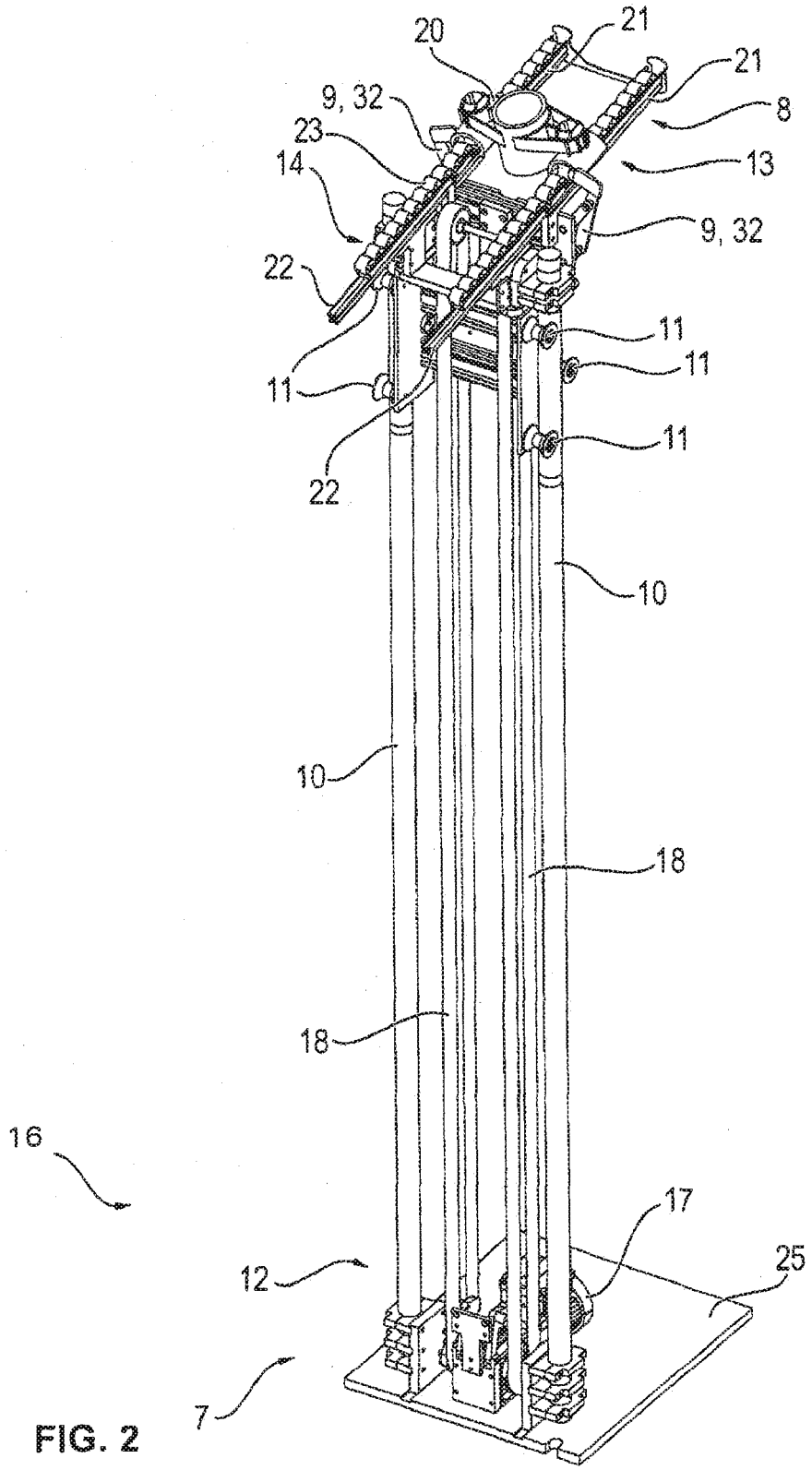
FIG. 2 shows an exemplary embodiment of an elevator of a restaurant system according to the invention in a three-dimensional view.

The first transport section 5 of the transport system 4 comprises two sliding rails 19, which run parallel and which have a circular cross section, on which the food and/or drinks are transported by means of transport aids 20, at least in sections by means of the force of gravity. FIG. 2 shows the elevator 7 of the restaurant system 1 according to the invention. The elevator 7 has a movable elevator unit 8, which carries the food and/or drinks during the transport of the food and/or drinks by means of the elevator 7. The elevator unit 8 can be moved between a receiving position 12, in which the food and/or drinks, which are to be transported, can be supplied to the elevator unit 8, and a transfer position 13, which is arranged above the receiving position 12 and in which the elevator unit 8 can transfer the food and/or drinks to the first transport section 5.

The elevator 7 comprises two vertically arranged guide rods for guiding the elevator unit 8 in response to the movement between receiving position 12 and transfer position 13. The elevator 7 furthermore has two sensors, which detect the reaching of the receiving position 12 or of the transfer position 13, respectively. The elevator unit 8 has transfer rails 21, which run parallel and which carry the food and/or drinks, which are placed or introduced into the transport aids 20, during the transport of the food and/or drinks by means of the elevator 7. In the transfer position 13 of the elevator unit 8, the transfer rails 21 form a continuation of the two sliding rails 19 in the first transport section 5 in a direction opposite the provided transport direction A of the food and/or drinks.

The connector 14 has two intermediate rails 22, which run parallel and which form a continuation of the sliding rails 19 and which are arranged between the sliding rails 19 and the transfer rails 21 in the transfer position 13 of the elevator unit 8.

Both the transfer rails 21 as well as the intermediate rails 22 are inclined downwards in the direction of the provided transport direction A of the food and/or drinks. The transfer rails 21 and the intermediate rails 22 are furthermore formed from a plurality of rollers 23, which are arranged consecutively and which are supported rotatably, and the axis of rotation of which is in each case oriented vertically to the transport direction A provided at the position thereof.

Figure 3:
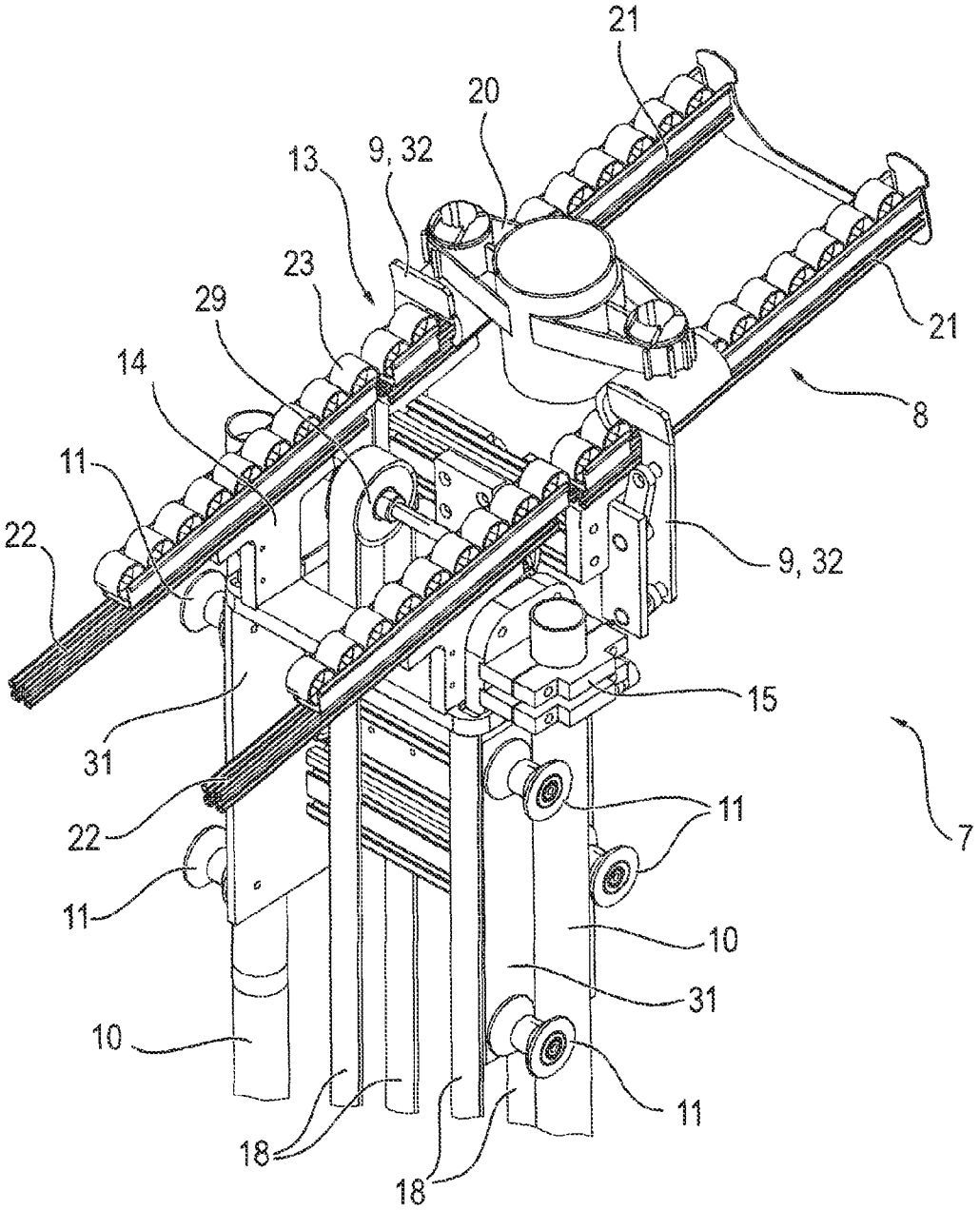
FIG. 3 shows an upper section of the elevator according to FIG. 2 in an enlarged detailed view.

FIG. 3 shows an upper section of the elevator 7. A stationary connector 14 is arranged on the upper end of the guide rods 10 in such a manner that the food and/or drinks can be transferred via the connector 14 to the first transport section 5, starting at the elevator unit 8 in the transfer position thereof. The position of the connector 14 can be adjusted on the upper end of the guide rods 10. A plurality of fastening means 15 of the connector 14 are fastened to the guide rods 10 in a detachable manner.

They can substantially be arranged so as to be offset and in a new manner so as to newly adjust the position of the connector 14 on the upper end of the guide rods 10. The elevator unit 8 has two barriers 9, which are in a closed state, in which they block a movement of the food and/or drinks, which are carried by the elevator unit 8. Such a movement would be made possible, because the force of gravity acts on the food and/or drinks, because the elevator unit 8 is located at an incline as compared to the horizontal. The barriers 9 are connected to the control device (not illustrated in the figures). If one of the sensors signals the reaching of the transfer position 13 to the control unit (not illustrated in the figures), said control unit transfers the barriers 9 from the closed into the open state and thus releases the transfer of the food and/or drinks to the first transport section 5.

Each of the two barriers are a mechanical coupling mechanism comprising an L-shaped angular piece 32, wherein, in the closed state, the short side of the angular piece 32 forms the stop point for the food and/or drinks. For guiding purposes, the elevator unit 8 has three wheels 11 on the guide rods 10, which are arranged in such a manner that two of the wheels 11 are in each case moved along opposite sides of the guide rods 10 in response to the movement of the elevator unit 8.

The wheels 11 are designed in a double cone-shaped manner, wherein the guide rods 10 are guided in an area between the two cones on a cylindrical center piece. The axes of rotation of the wheels 11 are located vertically to the guide rods 10 and the wheels 11 are located in a plane, which is vertical to the axes of rotation. The wheels 11 are thereby arranged in the plane in the shape of an equal-sided triangle, wherein the guide rods 10 are in each case arranged between base and tip of the equal-sided triangle. The wheels 11 are arranged on a frame structure in each case comprising one mounting plate 31 for each guide rod. Three wheel 11 for each mounting plate are thereby rotatably supported thereon. The wheels 11 are equipped with a brake to prevent an unintentional quick downward slipping of the elevator unit 8, for example in response to a tearing of a tie bar 18.

Figure 4:
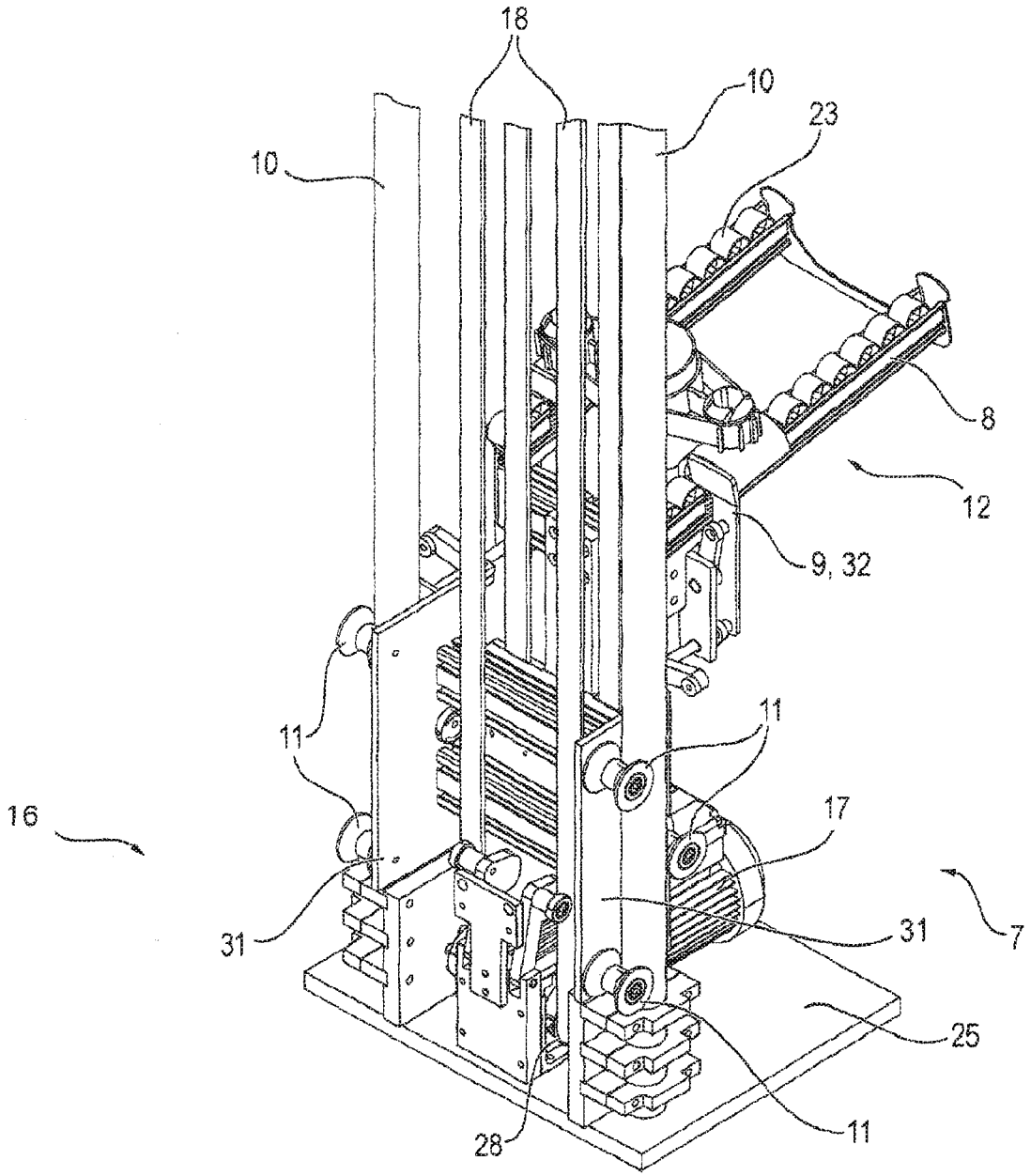
FIG. 4 shows a lower section of the elevator according to FIG. 2 in an enlarged detailed view.
Figure 5:
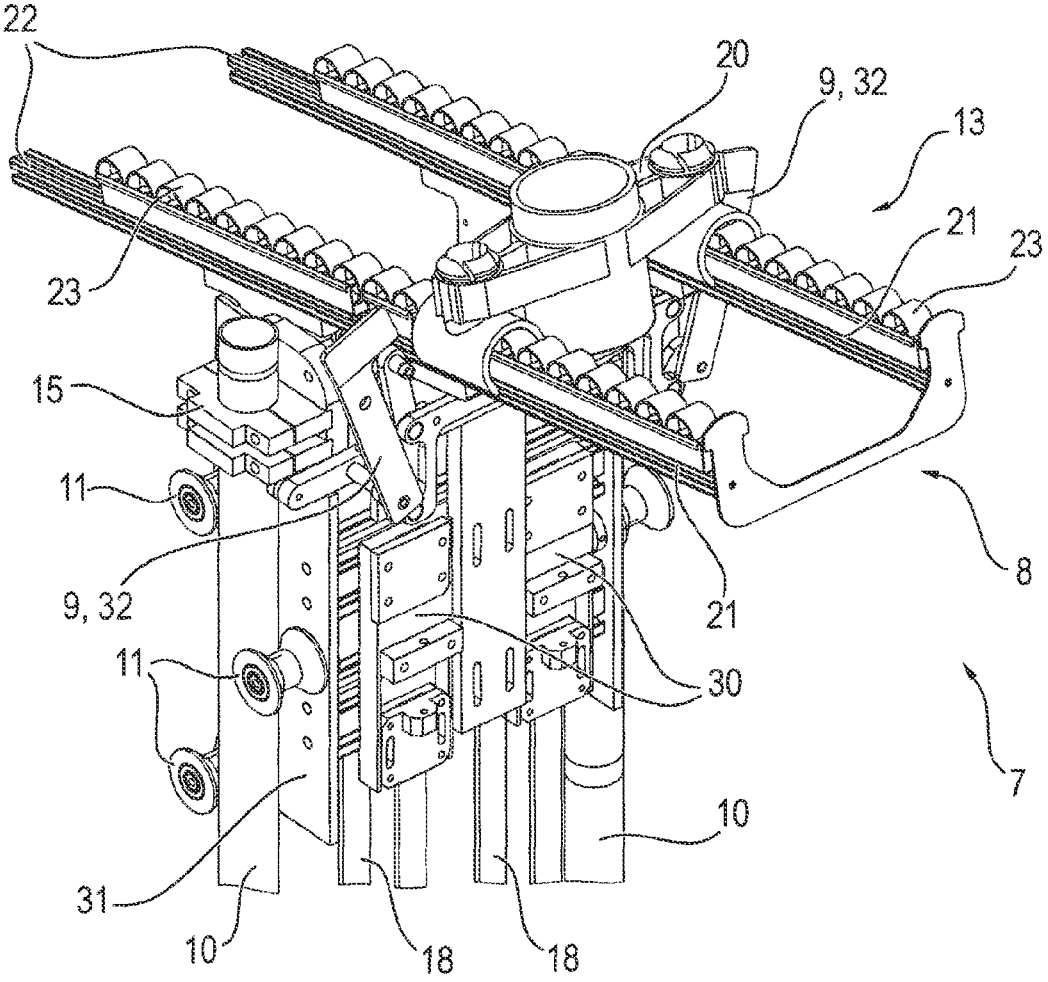
FIG. 5 shows the upper section of the elevator according to FIG. 2 in a further enlarged detailed view.
Figure 6:
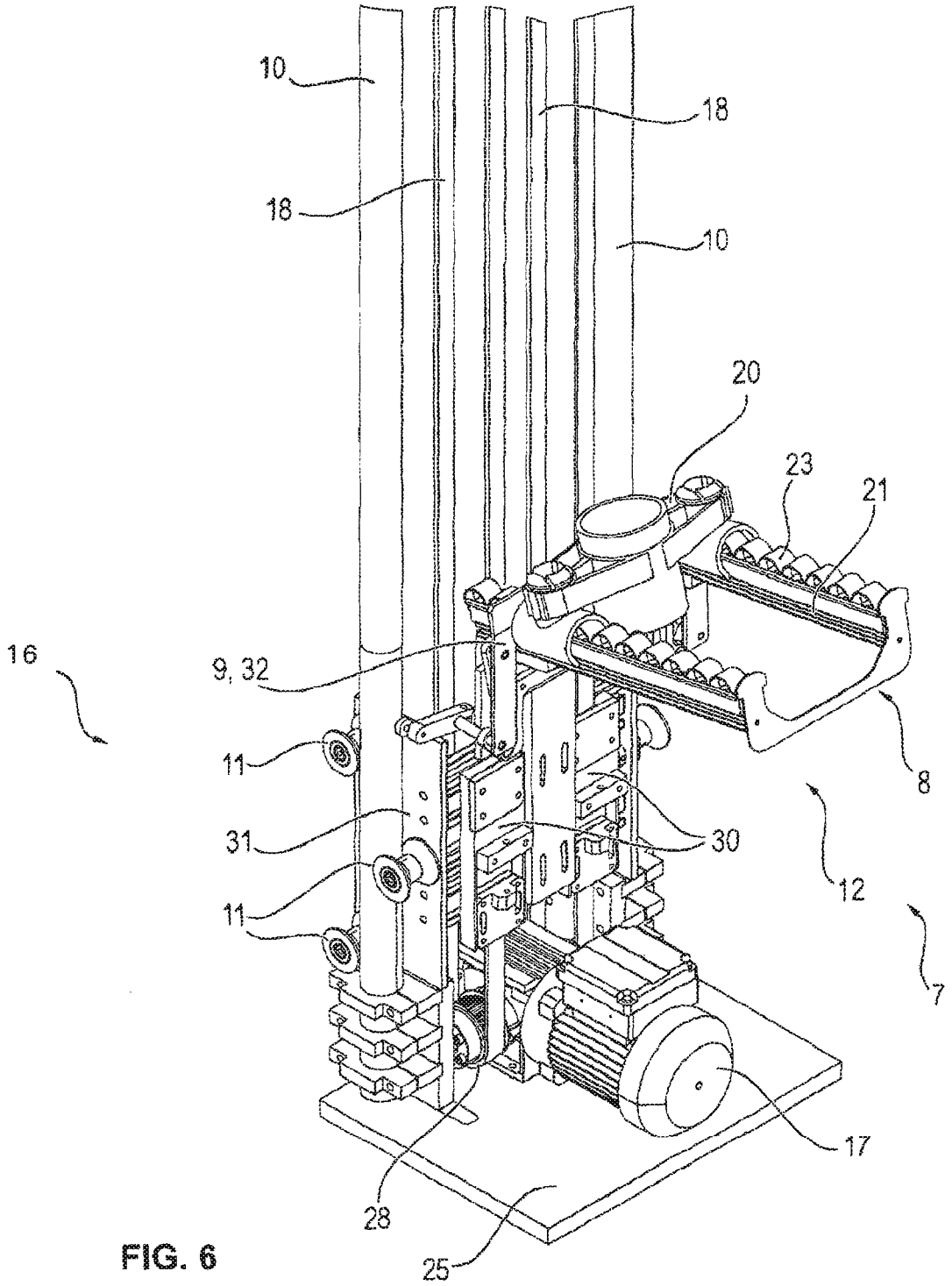
FIG. 6 shows the lower section of the elevator according to FIG. 2 in a further enlarged detailed view.

FIG. 4 and FIG. 6 show a lower section of the elevator 7. The elevator has a drive system 16 comprising a motor 17 and two tie bars 18, which are moved by the motor, wherein the elevator unit 8 is connected to tie bars 18 in such a manner that the elevator unit 8 is moved by means of the tie bars. Each tie bar 18 is stretched circumferentially between a drive roller 28 on the motor 17 and a deflection roller 29 (can be seen in FIG. 3). The motor 17 and the drive rollers 28 are arranged on the lower end of the guide rods 10; the deflection rollers 29 are arranged on the upper end of the guide rods 10. A mechanical connection 30 (can be seen in FIG. 5 and FIG. 6), which clamps the tie bars 18, and which ensures a stable and slip-resistant fastening, serves to connect the elevator unit 8 to the tie bars 18. The elevator 7 comprises a base plate 25 on the lower end of the guide rods 10. The guide rods 10 and the motor 17 are fastened to this base plate 25.

The control device of the elevator 7 can furthermore also be arranged below the base plate 25 (not illustrated in the figures).

FIG. 5 shows the elevator 7 according to FIG. 3 in an open state of the barriers 9. A movement of the food and/or drinks, which are carried by the elevator unit 8, in particular a transfer to the first transport section 5, is released in the open state.

LIST OF REFERENCE NUMERALS

1 restaurant system
2 working area
3 guest area
4 transport system
5 first transport section
6 second transport section
7 elevator
8 elevator unit
9 barrier
10 guide rods
11 wheels
12 receiving position
13 transfer position
14 connector
15 fastening means
16 drive system
17 motor
18 traction elements
19 sliding rails
20 transport aids
21 transfer rails
22 intermediate rails
23 rollers
24 protective box
25 base plate
26 side walls
27 upper side
28 drive roller
29 deflection roller
30 mechanical connection
31 mounting plate
32 angular piece A transport direction

The invention claimed is:

1. A restaurant system (1) comprising:

at least one working area (2) for cooking and/or preparing food and/or drinks;

at least one guest area (3); and a transport system (4);

wherein the at least one working area (2) and guest area (3) are connected via the transport system (4) for food and/or drinks, and the transport system (4) is designed to transport food and/or drinks from the working area (2) to the guest area (3), and the transport system (4) comprises at least a first transport section (5), in which the transport of food and/or drinks from the working area (2) to the guest area (3) takes place at least in sections by means of the force of gravity, and a second transport section (6), which is located upstream of the first transport section (5) in a provided transport direction (A) of the food and/or drinks;

wherein the second transport section (6) has an elevator (7), which is designed to transport the food and/or drinks into a position, which is located at a higher point as compared to the guest area (3); and the elevator (7) has at least one movable elevator unit (8), which carries the food and/or drinks by means of the elevator (7); and the elevator unit (8) can be moved between a receiving position (12), in which the food and/or drinks, which are to be transported, can be supplied to the elevator unit (8), and a transfer position (13), which is arranged above the receiving position (12) and in which the elevator unit (8) can transfer the food and/or drinks to the first transport section (5), and the elevator (7) further comprises:

one or two or a plurality of guide rods (10), which are arranged substantially vertically, for guiding the elevator unit (8) in response to the movement between receiving position and transfer position; and a stationary connector (14) is arranged on or close to an upper end of the guide rods (10) in such a manner that the food and/or drinks can be transferred via the stationary connector (14) to the first transport section (5), starting at the elevator unit (8) in the transfer position (13) thereof, and the position of the stationary connector (14) on or close to the upper end of the guide rods (10) can be adjusted by one or a plurality of fastening means (15) of the stationary connector (14) on one or a plurality of the guide rods (10) can be fastened to the guide rod or the guide rods (10) in a detachable and offset manner;

wherein the first transport section (5) of the transport system (4) comprises at least two sliding rails and/or roller guides (19), which run substantially parallel and have a substantially circular or oval or rectangular cross section, on which the food and/or drinks are transported by means of transport aids (20), at least in sections by means of the force of gravity, and that the elevator unit (8) has a number of transfer rails (21), which run substantially parallel and the number of which corresponds to the number of the sliding rails and/or roller guides in the first transport section (5) and which, during the transport of the food and/or drinks with the elevator (7), carry the food and/or drinks, which are placed into the transport aids (20), wherein, in the transfer position (13) of the elevator unit (8), the transfer rails (21) form a continuation of the sliding rails and/or roller guides (19) in the first transport section (5) in a direction opposite to the provided transport direction (A) of the food and/or drinks.

2. The restaurant system according to claim 1, characterized in that the elevator (7) is designed to transport the food and/or drinks upwards substantially inversely parallel to the force of gravity.

3. The restaurant system according to claim 1, characterized in that the elevator (7) has one or two or a plurality of sensors, which detect the reaching of the receiving position (12) and/or of the transfer position (13).

4. The restaurant system according to claim 1, characterized in that the elevator unit (8) has at least one barrier (9), which, in a closed state, blocks a movement of the food and/or drinks carried by the elevator unit (8), and which, in an open state, releases a movement of the food arid/or drinks carried by the elevator unit (8).

5. The restaurant system according to claim 1, characterized in that for guiding purposes, the elevator unit (8) has two or three or a plurality of wheels (11) on the guide rod or the guide rods (10), which are arranged in such a manner that at least two of the wheels (11) are moved along opposite sides of the guide rods (10) in response to the movement of the elevator unit (8).

6. The restaurant system according to claim 1, characterized in that the elevator (7) has a drive system (16) comprising a motor (17) and at least one or at least two traction elements (18), which are moved by the motor (17), wherein the elevator unit (8) is connected to the traction element or to the traction elements (18) in such a manner that the elevator unit (8) is moved by means of the traction element or the traction elements (18).

7. The restaurant system according to claim 1, characterized in that the elevator (7) comprises an emergency shut-off system, wherein the emergency shut-off system comprises a number of contact elements, which corresponds to the number of traction elements (18), wherein one contact element is in each case in contact with a traction element (18) during normal operation and is interrupted in the case of malfunction.

8. The restaurant system according to claim 1, characterized in that the elevator (7) comprises a brake mechanism comprising brake elements, wherein the brake effect of the brake elements is impeded by means of the traction elements (18) during normal operation, and slow down the elevator during malfunction.

9. The restaurant system according to claim 1, characterized in that the elevator has a protective box (24), which surrounds the elevator unit (8) in the receiving position (12) thereof at least laterally, and/or that the elevator unit (8) has a protective box, which is movable with the elevator unit (8) and which surrounds the elevator unit (8) at least laterally.

10. The restaurant system according to claim 1, characterized in that the elevator (7) has one or two or a plurality of sensors, which detects or detect an intervention in a route of the elevator unit along guide rods by an operator.

11. The restaurant system according to claim 1, characterized in that the stationary connector (14) has a number of intermediate rails (22), which run substantially parallel, and the number of which corresponds to the number of sliding rails and/or roller guides in the first transport section (5), which form a continuation of the sliding rails and/or roller guides (19) and which are arranged between the sliding rails and/or roller guides (19) and the transfer rails (21) in the transfer position (13) of the elevator unit (8).

12. The restaurant system according to claim 1, characterized in that the transfer rails (21) and/or intermediate rails (22) are inclined downwards in the direction of the provided transport direction (A) of the food and/or drinks.

13. The restaurant system according to claim 1, characterized in that the transfer rails (21) and/or intermediate rails (22) are formed of a plurality of wheels or rollers (23), which are arranged consecutively and which are supported rotatably, and an axis of rotation of which is in each case oriented substantially vertically to the transport direction (A) provided at the position thereof.

14. A restaurant system comprising:

at least one working area for cooking and/or preparing food and/or drinks;

at least one guest area; and a transport system; wherein the at least one working area and guest area are connected via the transport system designed to transport food and/or drinks from the working area to the guest area, wherein the transport system comprises a first transport section, in which the transport of food and/or drinks from the working area to the guest area takes place at least in sections by means of the force of gravity and a second transport section;

wherein the first transport section comprises at least two sliding rails and/or roller guides, which run substantially parallel, and have a substantially circular or oval or rectangular cross section, on which the food and/or drinks are transported by means of transport aids comprising sliding supports and/or sliding devices and/or rolling devices, at least in sections by means of the force of gravity, and the second transport section, upstream of the first transport section in a provided transport direction of the food and/or drinks, comprises an elevator, which is designed to transport the food and/or drinks into a position, which is located at a higher point as compared to the guest area; and the elevator comprises at least one movable elevator unit, which carries the food and/or drinks by means of the elevator; wherein the elevator unit can be moved between a receiving position, in which the food and/or drinks, which are to be transported, can be supplied to the elevator unit, and a transfer position, which is arranged above the receiving position and in which the elevator unit can transfer the food and/or drinks to the first transport section; wherein the elevator unit comprises a number of transfer rails, which run substantially parallel and the number of which corresponds to the number of the sliding rails and/or roller guides in the first transport section and which, during the transport of the food and/or drinks with the elevator, carry the food and/or drinks, which are placed into the transport aids, Wherein, in the transfer position of the elevator unit, the transfer rails form a continuation of the sliding rails and/or roller guides in the first transport section in a direction opposite to the provided transport direction of the food and/or drinks; and the transfer rails and/or intermediate rails are formed of a plurality of wheels or rollers, which are arranged consecutively and which are supported rotatably, and an axis of rotation of which is in each case oriented substantially vertically to the transport direction provided at the position thereof.

15. The restaurant system according to claim 14, wherein the elevator is designed to transport the food and/or drinks upwards substantially inversely parallel to the force of gravity.

16. The restaurant system according to claim 14, wherein the elevator comprises one or two or a plurality of guide rods, which are arranged substantially vertically, for guiding the elevator unit in response to the movement between receiving position and transfer position.

17. The restaurant system according to claim 16, wherein for guiding purposes, the elevator unit comprises two or three or a plurality of wheels on the guide rod or the guide rods, which are arranged in such a manner that at least two of the wheels are moved along opposite sides of the guide rods in response to the movement of the elevator unit.

18. The restaurant system according to claim 16, wherein the elevator further comprises a stationary connector arranged on or close to an upper end of the guide rods in such a manner that the food and/or drinks can be transferred via the stationary connector to the first transport section, starting at the elevator unit in the transfer position thereof, and the position of the stationary connector on or close to the upper end of the guide rods can be adjusted, one or a plurality of fastening means of the stationary connector on one or a plurality of the guide rods can be fastened to the guide rod or the guide rods in a detachable and offset manner.

19. A restaurant system, comprising:

at least one working area for cooking and/or preparing food and/or drinks;

at least one guest area; and a transport system;

wherein the at least one working area and guest area are connected via the transport system for food and/or drinks, and the transport system is designed to transport food and/or drinks from the working area to the guest area, and the transport system comprises at least a first transport section, in which the transport of food and/or drinks from the working area to the guest area takes place at least in sections by means of the force of gravity, and a second transport section, which is located upstream of the first transport section in a provided transport direction of the food and/or drinks;

wherein the second transport section has an elevator, which is designed to transport the food and/or drinks into a position, which is located at a higher point as compared to the guest area; and the elevator has at least one movable elevator unit, which carries the food and/or drinks by means of the elevator; and the elevator unit can be moved between a receiving position, in which the food and/or drinks, which are to be transported, can be supplied to the elevator unit, and a transfer position, which is arranged above the receiving position and in which the elevator unit can transfer the food and/or drinks to the first transport section, the elevator further comprises:

one or two or a plurality of guide rods for guiding the elevator unit in response to the movement between receiving position and transfer position; and a stationary connector is arranged on or close to an upper end of the guide rods in such a manner that the food and/or drinks can be transferred via the stationary connector to the first transport section, starting at the elevator unit in the transfer position thereof, and the position of the stationary connector on or close to the upper end of the guide rods can be adjusted, one or a plurality of fastening means of the stationary connector on one or a plurality of the guide rods can be fastened to the guide rod or the guide rods in a detachable and offset manner;

wherein the first transport section of the transport system comprises at least two sliding rails and/or roller guides, which run substantially parallel and have a substantially circular or oval or rectangular cross section, on which the food and/or drinks are transported by means of transport aids, at least in sections by means of the force of gravity, and that the elevator unit has a number of transfer rails, which run substantially parallel and the number of which corresponds to the number of the sliding rails and/or roller guides in the first transport section and which, during the transport of the food and/or drinks with the elevator, carry the food and/or drinks, which are placed into the transport aids, wherein, in the transfer position of the elevator unit, the transfer rails form a continuation of the sliding rails and/or roller guides in the first transport section in a direction opposite to the provided transport direction of the food and/or drinks.

20. The restaurant system according, to claim 19, wherein the transfer rails and/or intermediate rails are formed of a plurality of wheels or rollers, which are arranged consecutively and which are supported rotatably, and an axis of rotation of which is in each case oriented substantially vertically to the transport direction provided at the position thereof.

* * * * *